United States Patent [19]

Simopoulos et al.

[11] Patent Number: 4,647,337

[45] Date of Patent: Mar. 3, 1987

[54] METHOD OF MAKING ELECTROLUMINESCENT PANELS

[75] Inventors: Nicholas T. Simopoulos; George N. Simopoulos; Gregory N. Simopoulos, all of Dayton, Ohio

[73] Assignee: Luminescent Electronics, Inc., Dayton, Ohio

[21] Appl. No.: 801,511

[22] Filed: Nov. 25, 1985

Related U.S. Application Data

[63] Continuation of Ser. No. 677,645, Dec. 3, 1984, abandoned.

[51] Int. Cl.[4] ..... B44C 1/22

[52] U.S. Cl. ..... 156/633; 29/830; 29/847; 156/331.4; 156/332; 313/502; 313/506; 313/511; 313/512; 428/917

[58] Field of Search ..... 29/827, 830, 847, 738; 156/47, 52, 331.4, 331.7, 332, 633; 313/502, 506, 511, 512; 362/84; 428/917

[56] References Cited

U.S. PATENT DOCUMENTS

| | | | |
|---|---|---|---|
| 3,075,118 | 1/1963 | Thorton, Jr. . | |
| 3,110,837 | 11/1963 | Wollentin . | |
| 3,172,773 | 3/1965 | Blazek | 427/66 |
| 3,238,407 | 3/1966 | Jaffe . | |
| 3,263,110 | 7/1966 | Berg . | |
| 3,312,851 | 4/1967 | Flowers et al. | 428/11 |
| 3,475,640 | 10/1969 | Litant et al. | 313/498 |
| 3,497,750 | 2/1970 | Kochel et al. . | |
| 3,729,342 | 4/1983 | Velde | 427/64 |
| 4,297,681 | 10/1981 | Dircksen | 362/23 |
| 4,501,971 | 2/1985 | Ochiai | 250/483.1 |
| 4,508,636 | 4/1985 | Ochiai | 252/301.36 |
| 4,508,760 | 4/1985 | Olsen et al. | 427/213.34 |

*Primary Examiner*—Robert A. Dawson

*Attorney, Agent, or Firm*—Biebel, French & Nauman

[57] ABSTRACT

Flexible, electroluminescent panels or lamps employ a phosphor which is embedded in a coating formulation, in which a polyester laminating resin has been activated by a catalyst containing toluene diisocyanate or diphenylmethane diisocyanate, to provide a relatively high dielectric constant and to provide a flexible panel which is resistant to shorting, due to trimming, cutting or puncturing. The panel is characterized by relatively high efficiency and high light output.

7 Claims, 3 Drawing Figures

METHOD OF MAKING ELECTROLUMINESCENT PANELS

This is a continuation of Ser. No. 677,645 filed Dec. 3, 1984 and now abandoned.

BACKGROUND OF THE INVENTION

This invention relates to flexible electroluminescent (EL) panels, their composition and method of manufacture, both single sided as well as two sided.

In the past, flexible EL panels have been fabricated using a thin aluminum rear substrate electrode with a coating of barium titanate in a clear base, an EL phosphor in a clear base, an indium oxide coating (the front electrode), and a nylon 6 hydrophilic barrier. Leads are then attached, and finally the panel is laminated between two transparent fluorocarbon plastic layers at rather hign temperatures (about 420° to 450° F.). This is a costly method to fabricate EL panels.

SUMMARY OF THE INVENTION

The flexible EL panels of the present application enjoy an enhancement of light output due to the use of cyanide in the curing agent. The cyanides appear to provide a very high dielectric constant, in the order of 36. High strength "super glues" employing methyl cyanoacrylate have been used experimentally to fabricate small panels. This has led to more practical fabrication compositions using polyester resins and a cyanogen catalyst.

The EL lamps and processes of present invention employ a phosphor coating formulated from a polyester laminating resin, which is mixed with a catalyst or curing agent containing toluene diisocyanate (TDI) or diphenylmethane diisocyanate (MDI).

EL panels have been processed in the following manner:

An indium-tin-oxide (ITO) electrode is vacuum deposited onto a clear polyester base having a resistance of on the order of one hundred ohms per square. This will form the transparent electrodes of a completed panel. The opposite areas to which the connecting electrodes are to have good electrical connections, are etched away by the use of 18 to 20% hydrochloric acid, requiring only a few seconds (5 to 10 seconds) to etch the ITO surface. These areas are then masked to prevent them from being coated until the final stage of assembly.

The coatings can be applied by several metnods. The method of applying the phosphor coating depends on the desired result. Mayer rods may be used to apply identical layers to two pieces of transparent plastic with the ITO conductive coatings mentioned above. The phosphor-resin mixture may be thinned to allow more even application of the coating. The coatings are dried in an oven filled with dry nitrogen gas until dry to the touch. The leads are then attached. Following this step the two complementary panel sections are laminated together to form a single panel.

One of the particular advantages of the invention comprises the fact that a pair of substantially identical panel sections can be laminated together to form a completed panel, which completed panel is in and of itself essentially sealed without the necessity for encapsulation within clear thermal plastic sheets, as is commonly done, however, the edges of the panel can be sealed after being punched by a steel ruled die with a fluorocarbon resin to reduce water vapor transmission. Each panel section may consist of a layer of flexible dielectric base material, an electrode which consists of indium-tin-oxide (ITO), and a layer of phosphor in a coating or binding as described above. When suitable electrodes are attached, two such panel sections may be laminated together, in face-to-face relationship, phosphor to phosphor, to form a completed panel which may then be cut, punched, spindled or trimmed as desired or necessary without degredation and without shorting, providing light to the edges. The resistance to shorting is due primarily to the fact that the indium-tin-oxide electrode layers are exceedingly thin, in the order of a few Angstroms, and therefore are essentially incapable of forming a short circuit when punctured or cut. The lamination, under relatively low pressure and temperature, occurs by reason of the fusion of the coated layers to each other, without the necessity for the interposition of additional adhesives and thus eliminating the necessity subsequent encapsulation. Such a completed panel is completely transparent so that light is emitted equally through either surface or, alternatively, one or the other phosphor layers or backings may be provided, as desired, with opaque or reflective material to make a one-sided panel.

The invention further includes methods of attaching the electrical leads to both single sided and double-sided panels according to this invention.

EL panels which have been made in accordance with the present invention have had increased light output as compared to prior art devices, and are capable of providing light to the very edge of the panel. They are durable and generally resistant to handling, may be punched, and die cut to size or shape, or cut with scissors without creating shorts, are weatherproof, and are relatively inexpensive to fabricate. They can be operated over a wide temperature range from −55° C. to 125° C.

It is accordingly an object of this invention to provide a relatively low cost, easy to manufacture, long life flexible EL panel in which the coating formulation, having the phosphor embedded therein, comprises a polyester laminating resin which has been activated by a catalyst containing toluene diisocyanate or diphenylmethane diisocyanate, providing a relatively high dielectric constant in the order of ten or more. Panels constructed according to the method described herein exhibit a particularly high degree of resistance to shorting, due to trimming, cutting, or puncturing. The high dielectric constant provides a panel with a relatively high efficiency and high light output. Further, the light output may be and often is, carried directly to the edge of the panel.

These and other objects and advantages of the invention will be apparent from the following description, the accompanying drawings and the appended claims.

DESCRIPTION OF THE PREFERRED EMBODIMENTS

Figure 1:
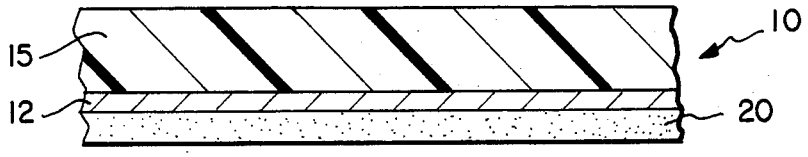
FIG. 1 is an enlarged sectional view of one panel section according to this invention.

Referring to the figures of the drawing which illustrate preferred embodiments of the method and product of this invention, FIG. 1 discloses a processed flexible electroluminescent panel section 10 in which an indium-tin-oxide electrode layer 12 is vacuum deposited on a clear polyester support or base 15, to form one transparent electrode. The clear polyester base electrode has a resistance in the order of 100 ohms per square. The layer 12 is shown exaggerated in thickness, as it is only a few angstroms thick.

A phosphor coating according to this invention is shown at 20 as applied to the electrode surface. The preferred phosphor coating employs a polyester laminating resin, such as Morton Adcote 503A (Morton Chemicals Company, 2 North Riverside Plaza, Chicago, Ill. 60606), or the number 49001 Polyester Resin, a laminating polyester adhesive of E. I. duPont deNemours & Co., (Inc.), Fabrics & Finishes Department, Wilmington, Del. 19898.

The polyester laminating resin is first thoroughly mixed with an EL phosphor in substantially equal volumetric proportions. This mixture may then be kept until it is to be used, at which time an activator or catalyst is added, such as Morton Chemicals Catalyst F or duPont's RC-803 Curing Agent. The Morton Chemicals Catalyst F and the duPont RC-803 are isocyanate curing agents and contain toluene diisocyanate (TDI) in an ethyl acetate solvent. The preferred mixture is about 5.25 parts of Catalyst F or duPont RC-803 Curing Agent to 100 parts of Morton Adcote 503A or duPont 49001 polyester resins with cyclohexanone solvent. Desmodur N-100, an aliphatic isocyanate resin, manufactured by Mobay Chemical Corporation, Pittsburgh, PA 15205, may be used as the catalyst or activating agent instead of Morton Chemicals Catalyst F or duPont RC-803, but in which case a smaller amount should be used, in the order of two parts of Desmodur N-100 to 100 parts of rasin, by weight.

The coating 20 may be applied to the base 15 by any suitable means, including the use of a Mayer rod. A Mayer rod is a wire wound doctor rod, as known in the art for after the application of an excess of the coating from an applicator roll. Its use is known in industries to produce recording tapes and reproductive papers. Blade coating, offset coating and fountain coating techniques, as well known in the photographic film and paper coating art, may similarly be used, as well as screen coating. In fact, one of the most practical arrangements by which EL panels can be fabricated consists of screen coating. The coatings to be applied should have relatively high viscosities, and the evaporation rate of the thinner must be at least an order of magnitudes slower than the thinner in the commercially available resin mix. Methyl ethyl ketone (MEK) toluene and acetone are thinners which normally could be applied to the resin for silk-screening. While the evaporative rates of such thinners are too high for practical use, it has been found that when cyclohexanone is used as a thinner, it permits sufficient working time to coat and prolong screen life. In order to permit the phosphor particles to pass through the silk screen, it has been found that about a 109 mesh screen provided satisfactory results.

After the phosphor-resin mixture is dried the leads are then attached. A preferred method and arrangement for attaching the leads is described below in connection with FIGS. 2 and 3. After the leads are attached, two of the panel sections, described above, are laminated together by first positioning the panels togetner with the pnosphor layers in contact with each other, as illustrated by the position of the panel sections in FIG. 2. The lamination is preferably accomplished by heated pressure-nip rollers at from 450° to 480° F. Alternatively, a heated platen laminator at 300° F. 420° F. with a pressure of from 400–600 pounds per square inch, for 5 to 10 minutes, may be used. The resin coatings fuse to each other and become essentially a single layer between the electrodes.

An example of a complete EL panel is described below. The dimensions of the panel are 1.3125 inches$\times$2.875 inches having a coated area of 3.773 square inches. The thickness of the coated plastic layers is 7.2 mils, and the thickness of the phosphor-resin layer is $(16.2-2\times7.2.)$ mils$=1.8$ mils.

The capacitance of a flat plate capacitor with air as the dielectic is given by $C=0.2244K\ A/d$ pf (pf: picofarad) where A is area in square inches and d is separation of the electrode in inches and K is the dielectric constant ($K=1$ taken for air as an approximation to a vacuum). Therefore, with air as the dielectric, the capacitance is calculated to be 470 pf. The EL panel with the same dielectric spacing was measured to have a capacitance of 6,250 pf which gives $K=13.3$, obtained by taking the ratio of 6250 pf to 470 pf. It has also been observed that the half life of the panel has also been considerably enhanced.

In some instances it is desirable to provide a urethane prepolymer resin and a diisocyanate catalyst combined with barium titanate or titanium dioxide in the phosphor carrier, to provide a white EL panel. The phosphor carrier may be a GA-83E urethane resin with an ethyl acetate solvent as manufactured by Polymer Industries, Greenville, S.C. 29602. The GA-83E resin is first weighed to obtain the volume desired, and an effective amount of barium titinate or titanium dioxide is added, which may be in the order of 2.0%. Phosphor in an amount equal to the amount of resin may then be added. Prior to use, this blend is then with an activating solution consisting of GA-83-CR1 resin of Polymer Industries, which contains diphenylmethane diisocyanate (MDI). The activator is mixed with the resin in the ratio of 5 parts activator to 9 parts resin. After coating and curing, this formulation has provided a superior white EL lamp which exhibited very little degradation with respect to time.

Figure 2:
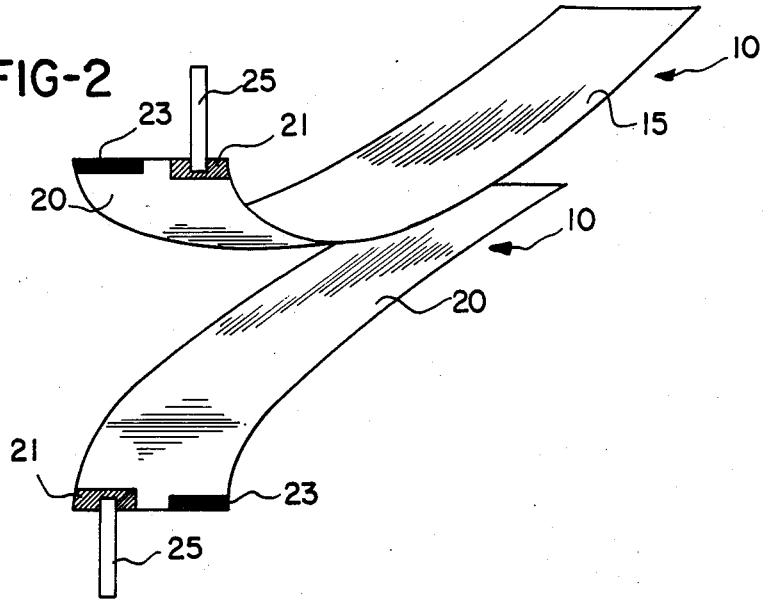
FIG. 2 is a diagram showing application of electrodes on a pair of panel sections prior to lamination.
Figure 3:
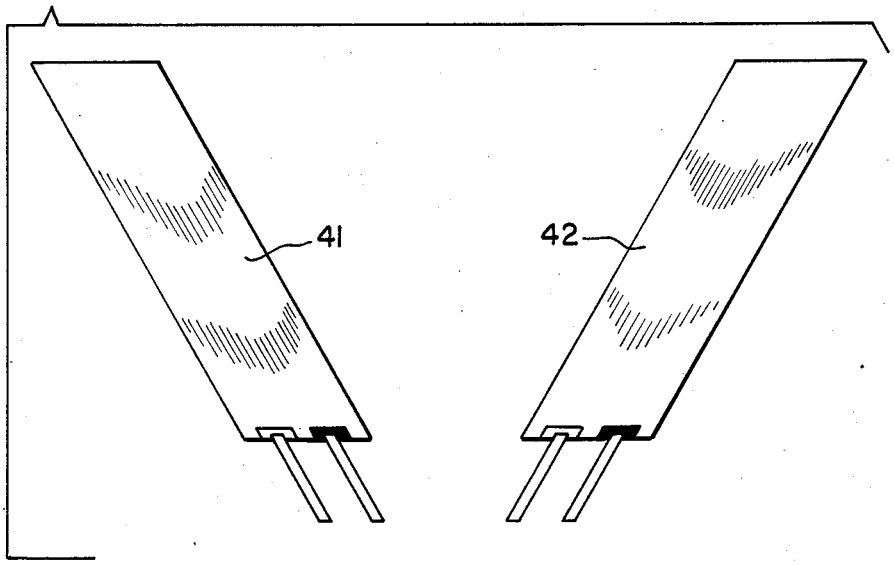
FIG. 3 shows how a single panel can be used to form a left-hand and and right-hand assembly.

FIG. 2 shows the method by which leads are conveniently attached to the upper leads or electrodes on a double-sided panel. Prior to coating an area indicated at 21 is etched away, on the conductive sides of the electrodes using 20% hydrochloric acid. This requires in the order of five to ten seconds. The width and length of the etched area 21 is slightly larger than the oppositely placed conductive area shown at 23 which is not etched away. Prior to coating this smaller area 23 is coated with a conductive coating, such as silver or nickel oxide, as used in the manufacture of hybrid circuitry known to those familiar with the art.

Tne conductive sides of the transparent electrodes are then suitably coated by the catalyzed resin-phosphor material, then allowed to dry as previously described. A small amount of catalyzed resin is applied to the side in contact with the area 23, and to one side of the flat conductor in contact with the insulated or etched area 21. The lead 25 is then pressed against the etched area well away from the coated phosphor area to prevent a short between the electrodes 12. The panel sections, with leads attached, are then aligned and laminated under the proper conditions prescribed above.

The completed panel allows the leads to be bent over in either direction or remain straight, depending on the configuration or the method of interconnection between the power source and the EL panel.

Since the completed panel of this invention is completely transparent, and emits light through either of its sides, it is particularly useful to provide an asymmetrically shaped panel which may be inverted for right-hand and left-hand operations. An example consists of the panels 41 and 42 shown in FIG. 3. The panels 41 and 42 may in fact be identical panels shown respectively in inverted positions. By suitably bending the electrodes or leads, in either direction, and by inserting a reflective material, such as aluminum coated plastic or providing a white rear coating, a single EL panel can be made which satisfies both requirements of a left-hand and right-hand version. The insertion of a reflective coating or the inclusion of the same on the back surface, of course, enhances the light output from the front or visible surface.

The advantages of manufacturing panels in the manner indicated above provides lighting to the very edges of the EL panel. The edges of the panels can be sealed with a clear waterproof coating, such as 3M's Kel F 800 brand flurocarbon conformal resin or in some cases, left unsealed.

While the methods herein described, and the forms of apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. The method of making a flexible transparent electroluminescent panel comprising the steps of:

applying a transparent electrode to a sheet of transparent flexible substrate dielectric material, attaching a lead to said electrode, coating over said electrode a laminating resin consisting of a polyester resin which has been activated by an activator containing diisocyanate and containing a phosphor dispersed therein to form a panel section, laminating together in a resin-to-resin contact two of said panel sections under heat and pressure to form a single panel.

2. The method of making an electroluminescent panel comprising the steps of:

applying a transparent electrode to a sheet of transparent flexible substrate dielectric material, coating said electrode with a laminating resin which has been catalyzed by an activator containing diisocyanate and having an electroluminenscent phosphor dispersed therein, applying a second dielectric and electrode to said resin to form an electroluminescent sandwich, and laminating said sandwich under heat and pressure.

3. The method of claim 2, including the step of mixing the resin, prior to applying to said panel, with an electroluminescent phosphor in substantially equal volumetric proportions of phosphor to resin.

4. The method of making a transparent electroluminescent comprising the steps of:

applying a transparent electrode to a sheet of transparent dielectric support material, applying a diisocyanate activated polyester resin coating containing electroluminescent phosphor to said transparent electrode to form a first panel section, making a second panel section by applying a transparent electrode to a second sheet of transparent dielectric support material and applying a diisocyanate activated resin containing an electroluminescent phosphor to the transparent electrode on said second sheet, and laminating said first and second sheets together with said resin layers in contact under heat and pressure to form an essentially homogeneous phosphor layer between transparent electrodes.

5. The method of applying electrical leads to each section of an electroluminescent panel in which each such section has an electrode thereon comprising the steps of:

on each of first and second superimposed panel sections, etching away discrete, non-aligned portions of the electrode, applying a lead to the second panel opposite the etched-away portion of the first panel and applying a lead to the first panel opposite the etched-away portion of the second panel, coating the remaining electrode area with a phosphor-containing resin which has been activated by an activator containing diisocyanate, and laminating the panel sections together resin to resin with the etched-away areas in alignment with the opposed leads.

6. The method of making a sealed, flexible, electroluminescent panel having outer surfaces of dielectric sheet material, comprising the steps of:

applying an electrode layer to a surface of each of a pair of flexible dielectric sheets in which at least one of said sheets and the associated electrode thereon are transparent, applying to each said electrode layer a layer of heat bondable phosphor-containing resin, and laminating said pair of sheets together under heat and pressure with said resin layers in face-to-face contact.

7. The method of making a sealed, flexible, double-sided electroluminescent panel having outer surfaces formed of transparent dielectric sheet material, comprising the steps of:

applying a transparent electrode layer to a surface of each of a pair of flexible transparent dielectric sheets, applying to each said electrode layer a layer of heat bondable phosphor-containing resin, and laminating said pair of sheets together under heat and pressure with said resin layers in face-to-face contact to form a sealed double-sided panel.

* * * * *